US008923727B2

(12) United States Patent
Watanabe et al.

(10) Patent No.: US 8,923,727 B2
(45) Date of Patent: Dec. 30, 2014

(54) PACKAGING ARRANGEMENT FOR IMAGE FORMATION APPARATUS ACCOMMODATING PROCESS CARTRIDGE

(75) Inventors: Yasunori Watanabe, Aichi (JP); Yasuo Kato, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 505 days.

(21) Appl. No.: 13/352,766

(22) Filed: Jan. 18, 2012

(65) Prior Publication Data

US 2012/0183327 A1 Jul. 19, 2012

(30) Foreign Application Priority Data

Jan. 18, 2011 (JP) ..... 2011-007625

(51) Int. Cl.

| | |
|---|---|
| ***G03G 15/00*** | (2006.01) |
| ***G03G 21/20*** | (2006.01) |
| ***G03G 21/16*** | (2006.01) |
| ***G03G 21/18*** | (2006.01) |

(52) U.S. Cl.

CPC .... *G03G 21/203* (2013.01); *G03G 2215/00383* (2013.01); *G03G 21/1633* (2013.01); *G03G 21/1853* (2013.01); *G03G 21/181* (2013.01)

USPC ..... 399/109

(58) Field of Classification Search

CPC ..... G03G 21/181

USPC ..... 399/109, 111

See application file for complete search history.

(56) References Cited

U.S. PATENT DOCUMENTS

2007/0071495 A1 3/2007 Hashimoto et al.

FOREIGN PATENT DOCUMENTS

| | | | |
|---|---|---|---|
| JP | 11-165916 | A | 6/1999 |
| JP | 2003-279742 | A | 10/2003 |
| JP | 2006-071671 | A | 3/2006 |
| JP | 2006-171407 | A | 6/2006 |
| JP | 2006-259448 | | 9/2006 |
| JP | 2007-186249 | A | 7/2007 |
| JP | 2010-054828 | A | 3/2010 |

OTHER PUBLICATIONS

JP Office Action dtd Jan. 22, 2013, JP Appln. 2011-007625, English translation.

*Primary Examiner* — David Gray
*Assistant Examiner* — Andrew V Do
(74) *Attorney, Agent, or Firm* — Banner & Witcoff, Ltd.

(57) ABSTRACT

An image formation apparatus is configured such that a process cartridge can be detachably attached through an opening, at which an openable cover is provided. A sheet accommodated in a sheet feed tray arranged below the process cartridge is to be upwardly fed along a first sheet feed path, while a second feed path is defined by the bottom face of the process cartridge and a path composing member oppositely arranged below the process cartridge. An opened portion is formed at a position, on the opening side, where the second feed path is connected to the first feed path. A first drying agent is arranged in the second feed path. An end of the first drying agent or a member connected to the first drying agent is exposed to outside of the second feed path through the opened portion so as to be visually recognizable when the cover is opened.

5 Claims, 8 Drawing Sheets

PACKAGING ARRANGEMENT FOR IMAGE FORMATION APPARATUS ACCOMMODATING PROCESS CARTRIDGE

CROSS-REFERENCE TO RELATED APPLICATION

This application claims priority under 35 U.S.C. §119 from Japanese Patent Application No. 2011-007625 filed on Jan. 18, 2011. The entire subject matter of the application is incorporated herein by reference.

BACKGROUND

1. Technical Field

Aspects of the invention relate to a packaging arrangement for an image formation apparatus, and specifically, to an arrangement for the image formation apparatus accommodating a process cartridge when packaged for shipping.

2. Related Art

Generally, it is known that toner contained in a process cartridge for an image formation apparatus is deteriorated by moisture absorption, which may lower quality of formed images. Therefore, typically, the process cartridge is packaged in an airtight bag or the like so that the toner therein remains in a dried condition, and is packaged separately from the main body of the image formation apparatus.

SUMMARY

For distributing the main body of the image formation apparatus and a process cartridge therefor, in view of shedding materials for packaging and efficiency for shipping, it is suggested that the image formation apparatus is packaged with the process cartridge being mounted therein so that they can be packaged in a single box. When the image formation apparatus is packaged with the process cartridge being mounted therein, it is necessary that a charging roller and a developing roller are spaced from a photoconductive drum so as to prevent the photoconductive drum from being damaged as it is in contact with and/or in friction with the charging roller and/or developing roller by vibratory motion occurred during transportation.

When the image formation apparatus is packaged with the process cartridge being mounted therein, it is impossible to package the process cartridge in an airtight container. Therefore, it is difficult to maintain the toner in the dried condition.

Aspects of the invention provide a packaging arrangement for an image formation apparatus which can suppress moisture absorption of the toner contained in the process cartridge.

According to aspects of the invention, there is provided a packaging arrangement of an image formation apparatus and a process cartridge, which includes a main body of the image formation apparatus formed with an accommodation chamber configured to accommodate the process cartridge, the main body being formed with an opening through which the process cartridge is detachably attached to the main body, the image formation apparatus being configured to be packaged with the process cartridge attached in the accommodation chamber, an openable cover configured to openably cover the opening, a sheet feed tray arranged below the process cartridge and accommodating sheets, a first sheet feed path being defined such that a sheet is upwardly fed from the sheet feed tray and fed to a position in the vicinity of the bottom face of the process cartridge along the first sheet feed path, a second feed path being defined by the bottom face of the process cartridge and a path composing member arranged below and opposite to the bottom face of the process cartridge, the second feed path being connected with the first feed path, the second feed path having an opened portion at a position where the second feed path being connected to the first feed path, the opened portion being open toward the opening of the main body, and a first drying agent arranged in the second feed path with the process cartridge being attached to the main body, one of an end of the first drying agent and a member connected to the first drying agent being exposed to outside of the second feed path through the opened portion.

BRIEF DESCRIPTION OF THE ACCOMPANYING DRAWINGS

DETAILED DESCRIPTION

A packaging arrangement of an image formation apparatus according to embodiments of the invention will be described with reference to the accompanying drawings.

Figure 1:
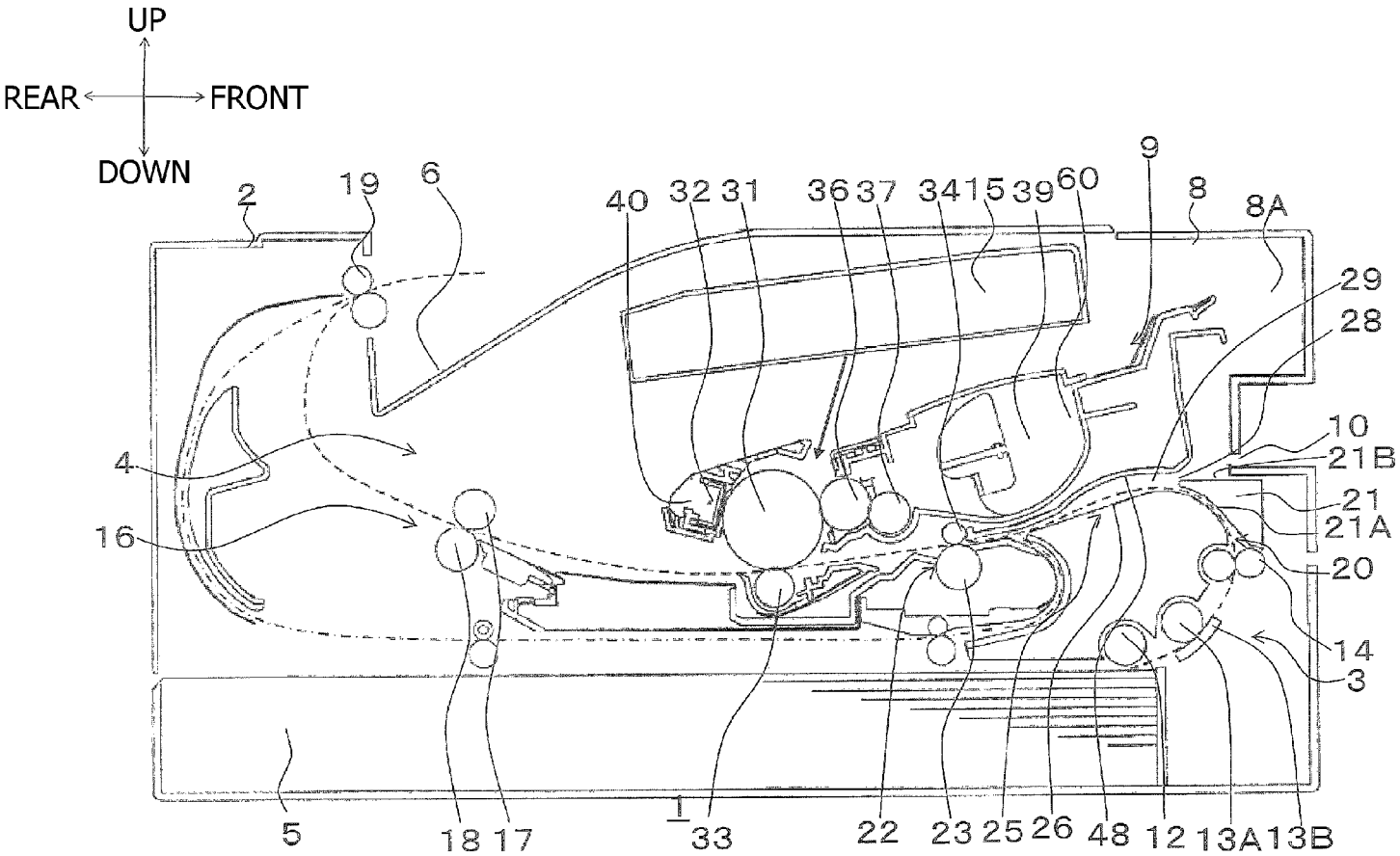
FIG. 1 is a cross-sectional side view of an image formation apparatus according to an embodiment of the invention.

As shown in FIG. 1, the image formation apparatus 1 has a housing 2. Inside the housing 2, provided are a sheet feed unit 3 from which sheets S are to be fed, an image formation unit 4 configured to form an image on each sheet S, a sheet tray 5 configured to contain the sheets S on which images have not yet been formed, and a discharge tray 6 configured to receive image-formed and discharged sheets S.

For the purpose of indicating directions in the following description, directions are defined as indicated in FIG. 1. The directions are basically defined in view of a user who uses the image formation apparatus 1. Specifically, a front cover 8 side is defined as a front side, and an opposite direction is defined as a rear side. A direction from the front side to the rear side is occasionally referred to as a depth direction. An up and down directions in FIG. 1 are defined as top and bottom directions, respectively. Further, although not shown in FIG. 1, a left side and a right side of the image formation apparatus are defined as a near side and far side with respect to a plane of FIG. 1, respectively.

Figure 2:
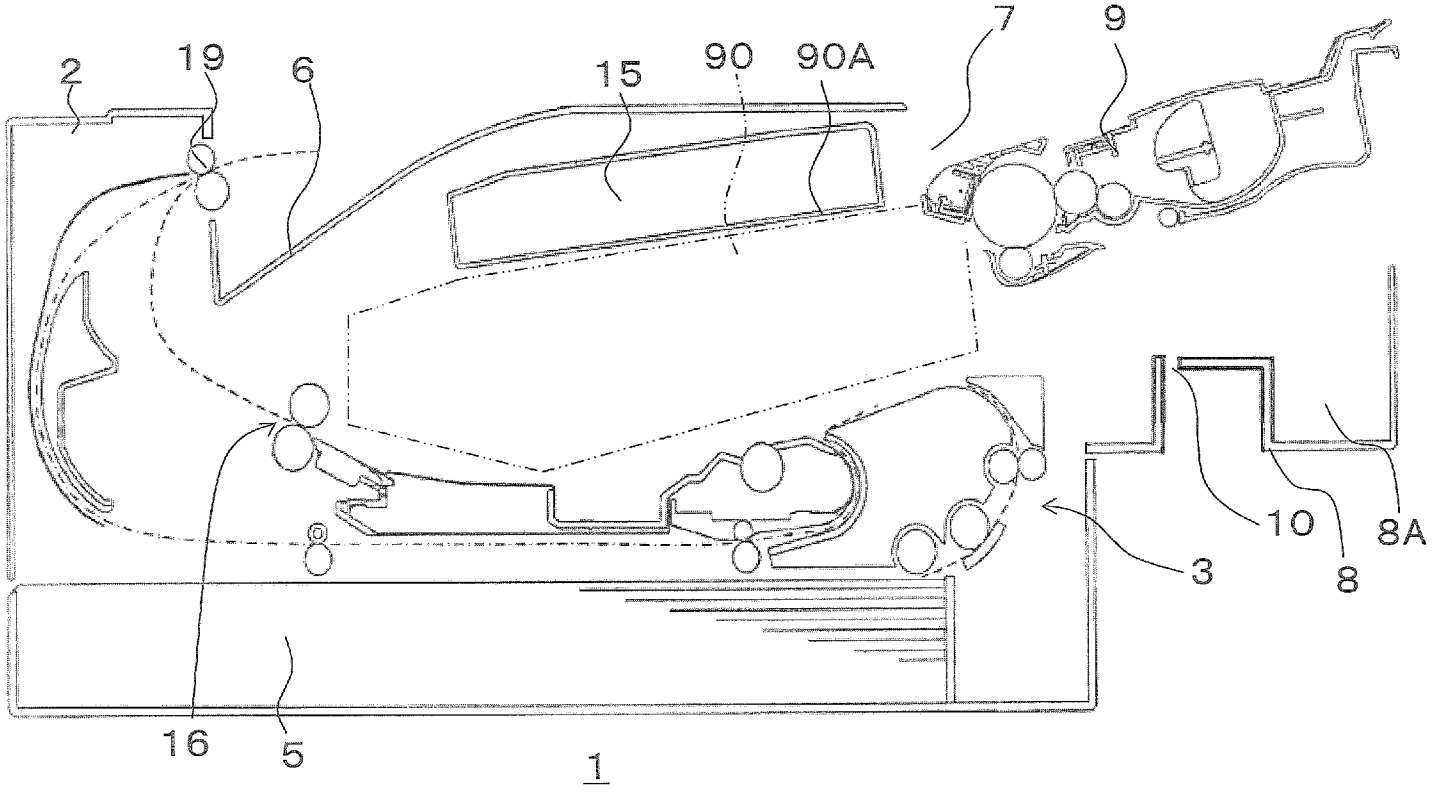
FIG. 2 is a cross-sectional side view of the image formation apparatus when a process cartridge is inserted in or removed from the image formation apparatus according to the embodiment of the invention.

As shown in FIG. 2, an opening 7 is formed on the housing 2. Through the opening 7, the process cartridge 9 can be inserted in and/or removed from the image formation apparatus 1. Further, an openable/closeable front cover 8 configured to completely expose and/or cover the opening 7 is rotatably supported onto the housing 2. On the front cover 8, a manual feed opening 10 is formed to penetrate in the front-and-rear direction. Through the manual feed opening 10, a sheet S can be fed toward the image formation unit 4 (see FIG. 1). It is noted that, according to another configuration, the manual feed opening 10 may be formed on a front face of the housing 2 instead of the front cover 8. Further to the above, the front cover 8 is formed with a concave portion 8A, which is formed to extend on inner side of the image formation apparatus 1, at a portion between an upper face of the front cover 8 and the manual feed opening 10. The concave portion 8A extends in the right-and-left direction (i.e., a direction perpendicular to the plane of FIG. 1).

Figure 7:
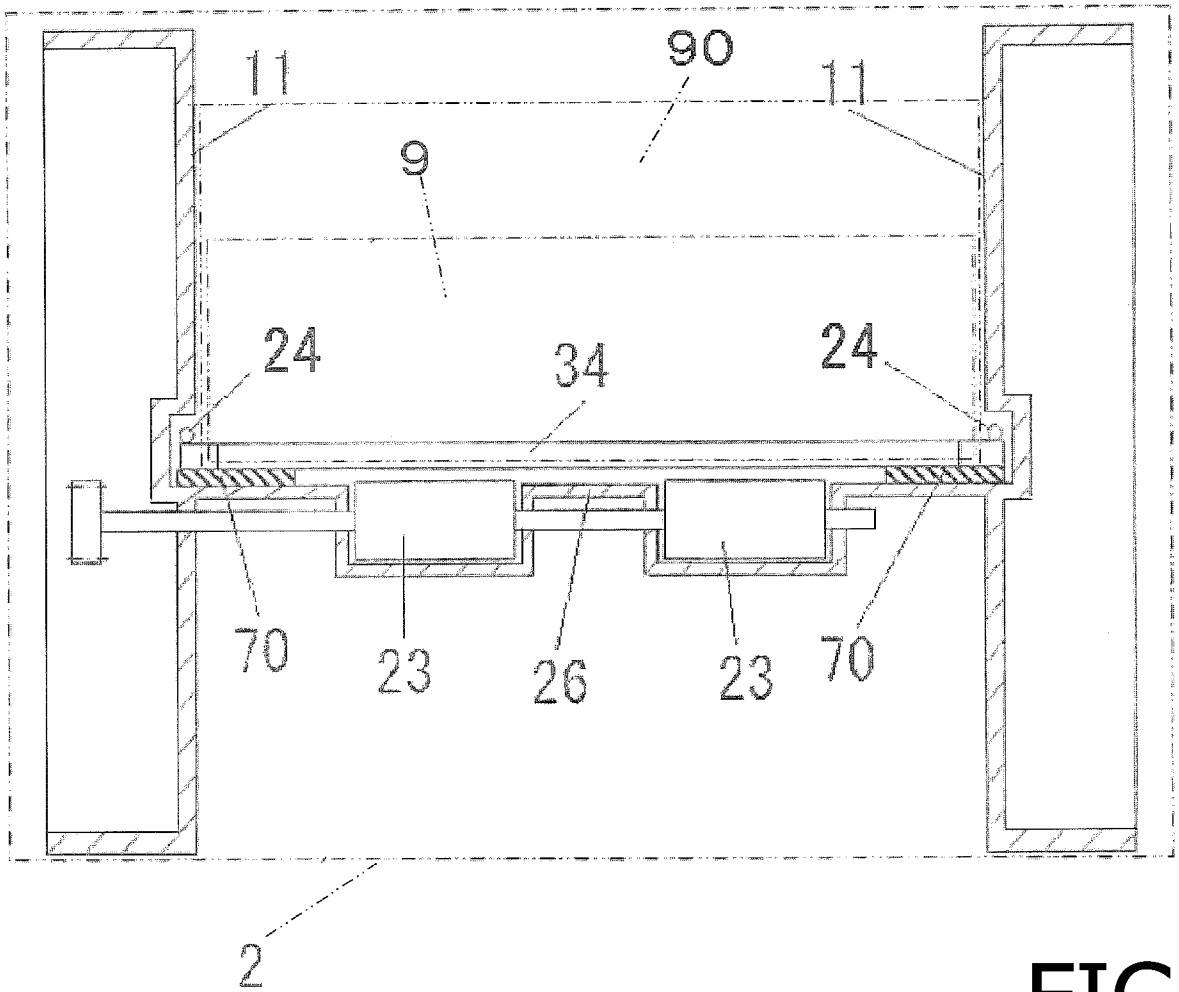
FIG. 7 is a cross-sectional front view of the image formation apparatus viewed from the front side thereof, according to the first embodiment of the invention.

Main components such as the image formation unit 4 and the process cartridge 9 are supported by a pair of frames 11 which are arranged on right and left sides of the image formation apparatus 1, and extends in the front-and-rear direction, as shown in FIG. 7. In the following description, the housing 2 including components therein (e.g., the pair of frames 11, the sheet feed unit 3, an exposure unit 14, and a fixing unit 16) except for the process cartridge 9 will occasionally be referred to as a "main body" of the image formation apparatus 1. Inside the main body, between the pair of frames 11, and between the exposure unit 15 and a feed path composing member 26, a cartridge accommodation chamber 90 for accommodating the inserted process cartridge 9 is formed. The front side of the cartridge accommodation chamber 90 communicates with the opening 7, and the bottom face of the exposure unit 15 defines a ceiling face 90A of the cartridge accommodation chamber 90 (see FIGS. 1 and 7).

Sheet feed operation and image formation operation will be described in detail.

Figure 3:
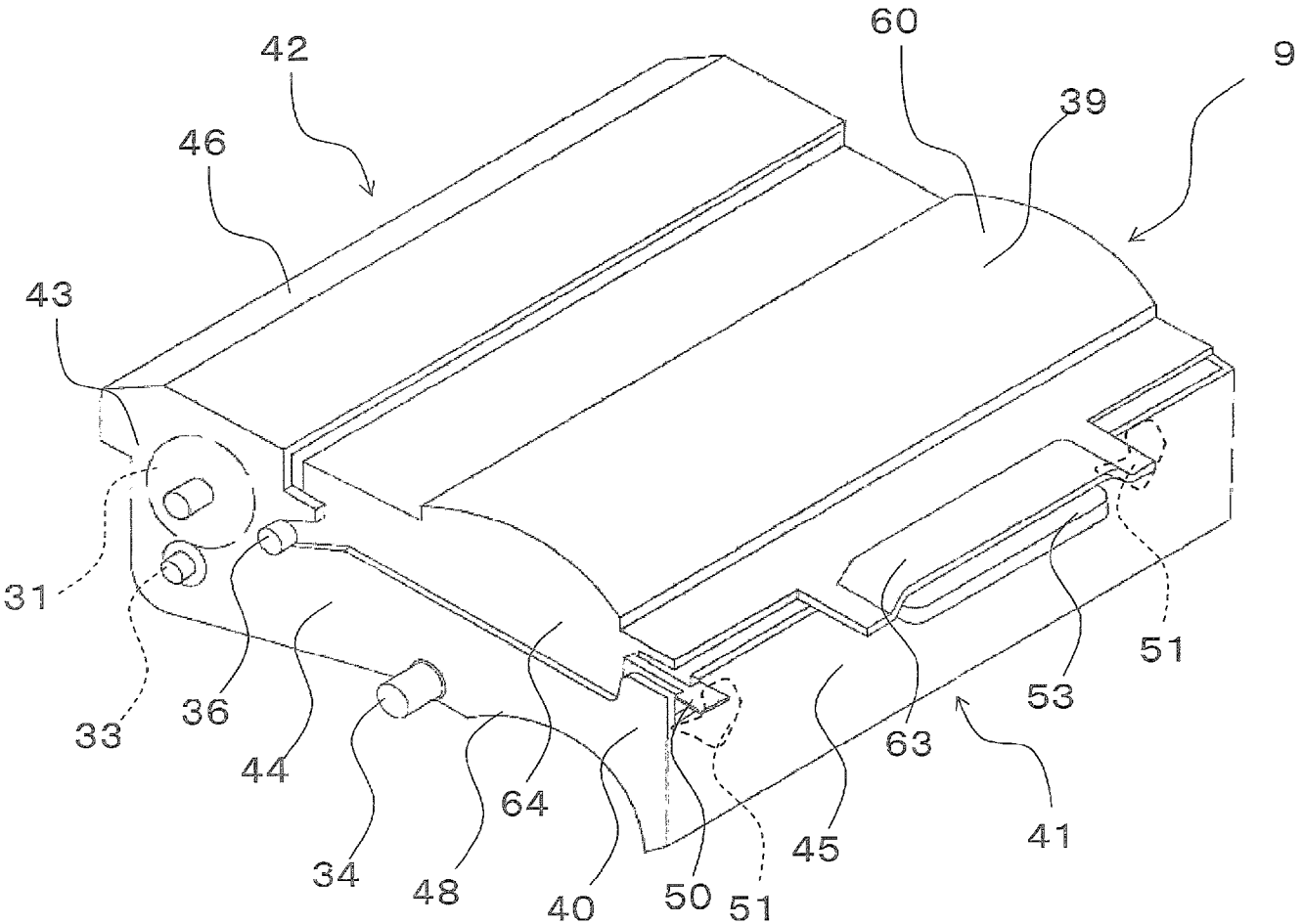
FIG. 3 is a perspective view of the process cartridge to be inserted in the image formation apparatus according to the embodiment of the invention.

As shown in FIG. 3, the sheet feed unit 3 is provided with a pick-up roller 12, a separation roller 13A, a separation pad 13B and a pair of feed rollers 14. The sheet feed unit 3 separates a sheet S from a stuck of sheets S accommodated in the sheet feed tray 5, and feeds the separated sheet S toward the image formation unit 4.

The sheet feed tray 5 is arranged below the process cartridge 9, and the sheet S picked up from the sheet feed tray 5 is fed, via a first feed path 20 and a second feed path 25, toward a position below the process cartridge 9. The first feed path 20 includes a U-shaped path, which has a U-shaped cross-sectional side view. The sheet S as fed is reversed as passing the U-shaped path, and is located below the process cartridge 9.

On an outside of the U-shaped path, a guide member 21 is disposed, and a lower face 21A of the guide 21 defines at least a part of the first feed path 20. An upper face 21A of the guide member 21 is disposed adjacent to an inner end of the manual feed opening 10 and guides the sheet S inserted through the manual feed opening 10 toward the image formation unit 4.

The second feed path 25 is defined between a sheet feed surface 48 which is formed by a lower face of the process cartridge 9 and the feed path composing member 26 opposing to the sheet feed surface 48. The second feed path 25 is connected from the first feed path 20, extends on the downstream side of the first feed path 20, and is connected to the nip between the photoconductive drum 31 and the transfer roller 33. At a position midway through the second feed path 25, a pair of register rollers 22 are disposed. Specifically, the pair of register rollers 22 includes a main body side register roller 23 disposed to the feed path composing member 26 and a cartridge side register roller 34 disposed to the lower face of the process cartridge 9.

The feed path composing member 26 is formed to bridge between the pair of frames 11 as shown in FIG. 7. As described later, since the process cartridge 9 is removable with respect to the main body, the second feed path 25 is formed when the process cartridge 9 is attached to the main body, and in such a state, the pair of register rollers 23 and 34 are arranged to contact with each other. When the process cartridge 9 is attached to the main body, the cartridge side register roller 34 is urged, at right-and-left side ends thereof, by springs 24 provided to the frames 11 such that the cartridge side register roller 34 is urged against the main body side register roller 23 at a predetermined pressure.

Between the guide member 21 and the sheet feed surface 49, an opening portion 28 exposed toward the opening 7 is formed. The opening portion 28 enables feeding of the sheet S inserted through the manual feed opening 10 toward the second feed path 25.

The sheet feed surface 48 is formed to have an upwardly concave shape so as to provide an admissible space 29 for allowing the sheet S, of which the leading end is to be registered by the nip of the pair of register rollers 22, to bend.

The image formation unit 4 is provided with the process cartridge 9, the exposure unit 15 and the fixing unit 16.

The exposure unit 15 is disposed at an upper portion inside the housing 2. The exposure unit 15 emits light (i.e., a laser beam indicated by arrowed broken line), which is modulated based on image data, toward the photoconductive drum 31.

The process cartridge 9 is configured to be inserted through the opening 7, between the exposure unit 15 and the feed path composing member 26, in a direction perpendicular to an axis of the photoconductive drum 31, and disposed at a predetermined position as positioned by a positioning member (not shown) provided to the frames 11. Inside the process cartridge 9, the photoconductive drum 31, the developing roller 36, a toner supplying roller 37 and a toner chamber 39 are arranged from the rear side to the front side thereof. On an upper rear side of the photoconductive drum 31, a scorotron type charger 32 is disposed, and below the photoconductive drum 31, the transfer roller 33 is disposed. Each of the photoconductive drum 31, and rollers 36, 37 and 33 extends in the right-and-left direction, and rotatable about an axis which also extends in the right-and-left direction.

When an image is formed on the sheet S, the toner in the toner chamber 39 is supplied to the developing roller 36 by the toner supplying roller 37. At this stage, the toner is frictionally charged between the toner supplying roller 36 and the developing roller 36 in a positive polarity.

The thickness of the toner supplied on the circumferential surface of the developing roller 36 is regulated by a regulating member as the developing roller 36 is rotated, and retained thereon as a thin layer of toner having a predetermined thickness.

The circumferential surface of the photoconductive drum 31 is uniformly and positively charged by the charger 32 as the photoconductive drum 31 rotates, and then exposed to a high-speed scanning laser beam emitted from the exposure unit 15. Then, an electrostatic latent image corresponding to an image to be formed on the sheet S is formed on the circumferential surface of the photoconductive drum 31.

The toner retained on the circumferential surface of the developing roller 36 is supplied to the electrostatic latent image formed on the circumferential surface of the photoconductive drum 31. As the toner is supplied, the electrostatic latent image is developed (i.e., visually recognizable image is formed). That is, on the circumferential surface of the photoconductive drum 31, a toner image according to reversal development is retained.

The toner image retained on the circumferential surface of the photoconductive drum 31 is transferred onto the sheet S when passing through the nip between the photoconductive drum 31 and the transfer roller 33.

The fixing unit 16 is arranged on a rear side of the process cartridge 9. The fixing unit 16 is provided with a heat roller 17, and a pressure roller 18 facing the heat roller 17. The toner image transferred onto the sheet S in the process cartridge 9 is fixed by heat and pressure which are applied to the sheet S when passing through the nip between the heat roller 17 and the pressure roller 18.

The sheet S on which the toner image is fixed is fed toward the discharge roller 19, and discharged by the discharge roller 19 onto the discharge tray 6 arranged above the exposure unit 15.

Figure 4:
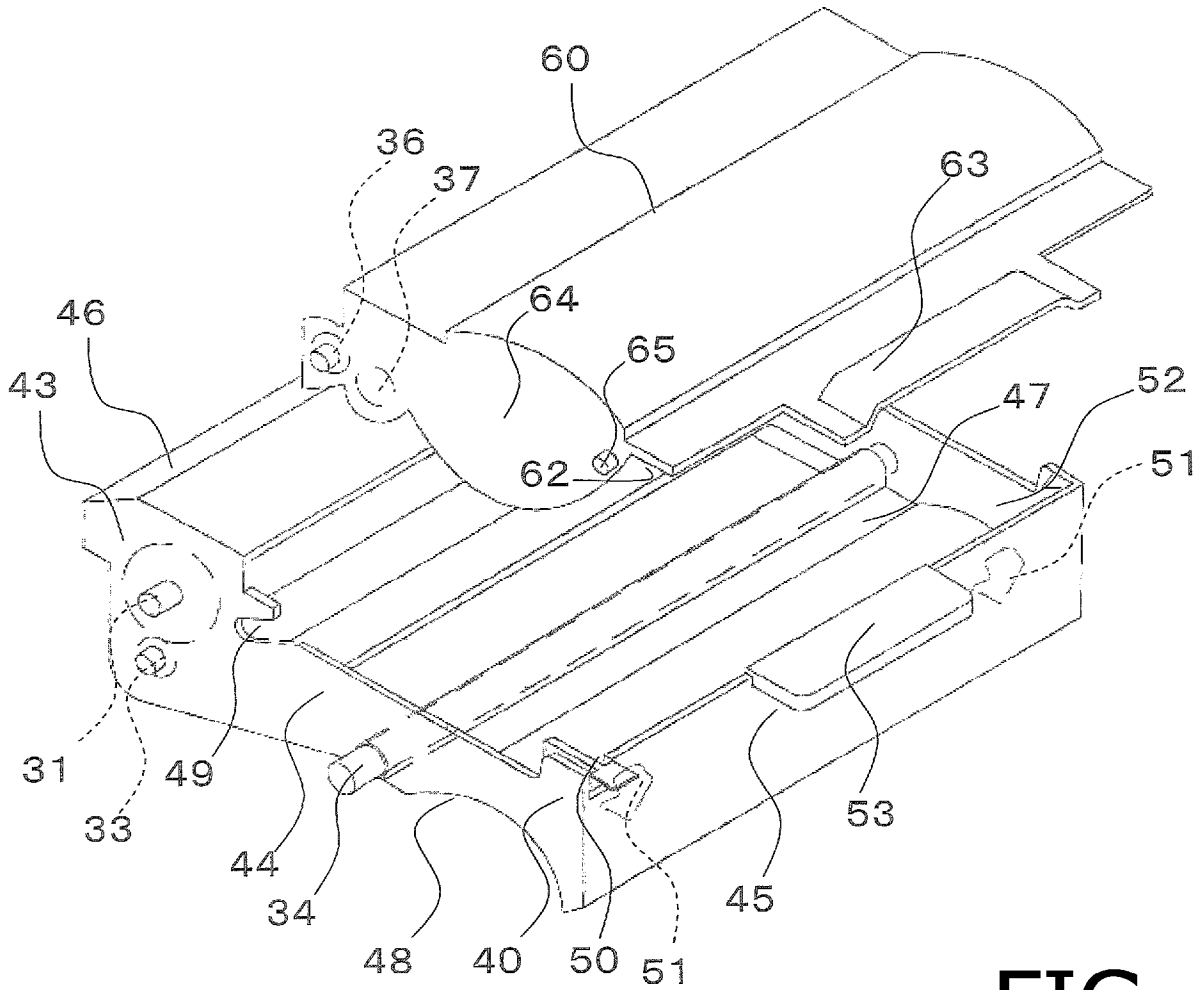
FIG. 4 is a perspective view of the process cartridge when a toner cartridge is attached to or detached from the process cartridge.

The process cartridge 9 is provided with a drum cartridge 40 and the toner cartridge 60 as shown in FIGS. 3 and 4. The photoconductive drum 31 and other rollers 36, 37 and 33 are distributed between the drum cartridge 40 and the toner cartridge 60, and supported therein.

The drum cartridge 40 has a frame 43 which has a generally box-like shape as shown in FIG. 3. The frame 43 has a bottom wall 47, a pair of side walls 44 which are raised up at the right-and-left side ends of the bottom wall 47 with a space therebetween, a front wall 45 which is disposed on the opening 7 side when the process cartridge 9 is attached to the main body, and a rear wall 46 which is disposed opposite to the front wall 45. The pair of side walls 44, the front wall 45 and the rear wall 46 are continuously connected to form a rectangular shape in plan view thereof.

The pair of side walls 44 rotatably support the photoconductive drum 31 and the transfer roller 33 at a rear portion 42 which is adjacent to the rear wall 46. An upper end of the rear wall 46 extends toward the front side so that the extended portion is located above the photoconductive drum 31 to cover the same.

The front portion 41 of the toner cartridge 40, which is located on the front side of the front end of the extended portion of the rear wall 46, is configured to form a toner cartridge accommodation section 52, which is a concave portion surround by the pair of side walls 44 and the front wall 45 and open to upward.

The toner cartridge 60 has a top wall, a bottom wall, a pair of side walls 64 and a front wall 62, which surround the toner chamber 39. The toner cartridge 60 does not have a rear wall and configured to have a box-like shape with its rear side being exposed to outside. The developing roller 36 and the toner supplying roller 37 are rotatably supported by the pair of side walls 64, and the developing roller 36 is exposed to outside through the rear side of the toner cartridge 60.

On the side walls 44, positioning slits 49 are formed by cutting out the side walls 44 toward the photoconductive drum 31. The toner cartridge 60 is mounted on the frame 43 such that the end portions, which are protruded from the toner cartridge 60, of the shaft of the developing roller 36 are inserted in the positioning slits 49, and urged toward the photoconductive drum 31 by an urging member 51. When mounted, the circumferential surface of the developing roller 36 is located close to the circumferential surface of the photoconductive drum 31. The toner cartridge 60 is held as a lock lever 50 engages with a protrusion 65 of the side wall 64 with the toner cartridge 60 is fitted in the cartridge accommodation section 52. When the lock lever 50 is released from the protrusion 65, the toner cartridge 60 can be removed from the cartridge accommodation section 52.

It is noted that the process cartridge 9 side sheet feed surface 48 is defined by the lower surface of the bottom wall 47. The register roller 34 is rotatably supported by the bottom wall 47 with a part thereof is exposed from the bottom wall 47.

The drum cartridge 40 and the toner cartridge 60 have grip portions 53 and 63 extending toward the opening 7, respectively. The grip portions 53 and 63 are gripped by a user when the process cartridge 9 is attached to and/or detached from the main body.

According to the embodiments, the image formation apparatus can be packaged with the process cartridge 9 being mounted inside the image formation apparatus 1 so that materials for packaging can be reduced, and transportation efficiency is improved.

Figure 5:
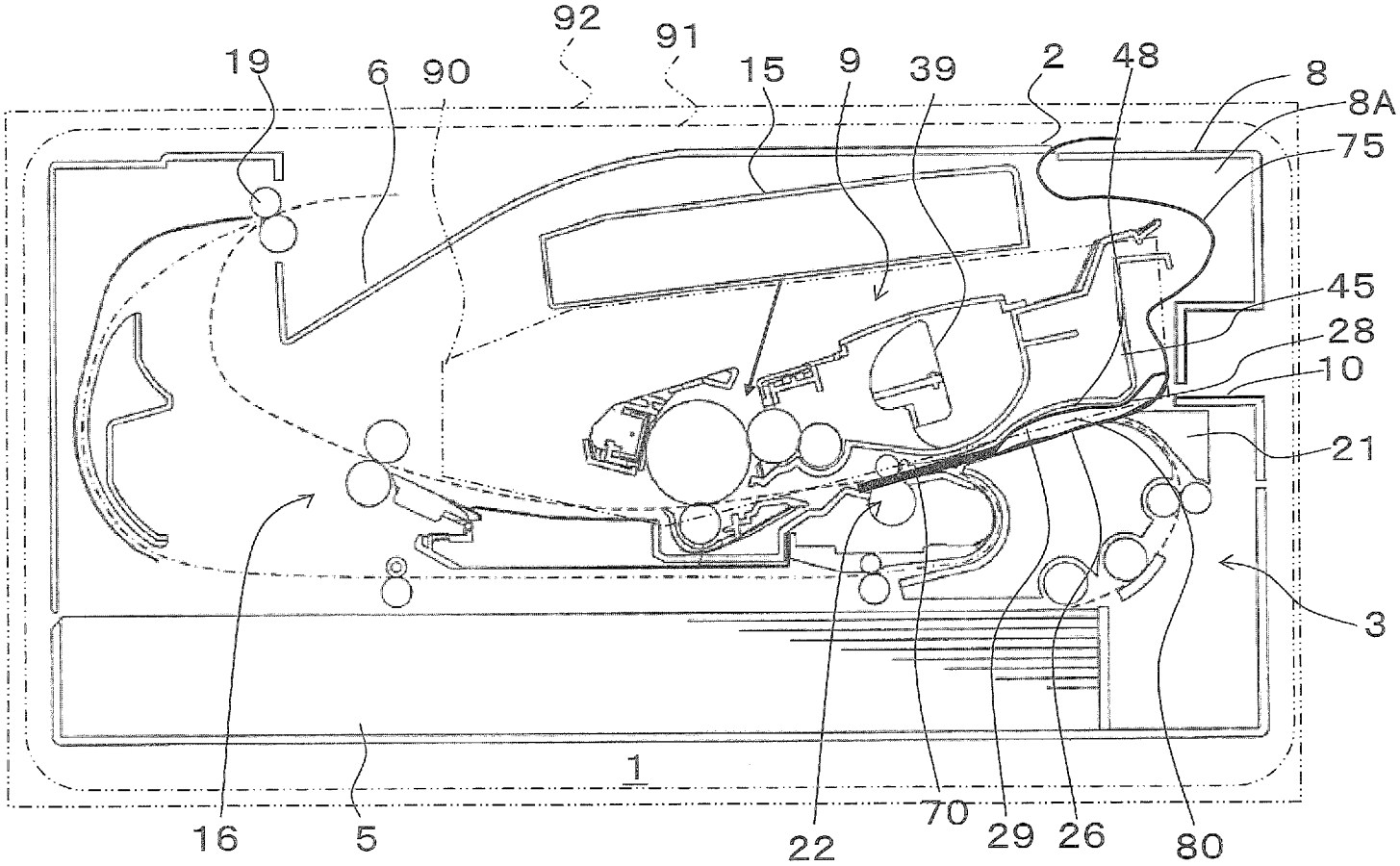
FIG. 5 is a cross-sectional side view of the image formation apparatus showing a packaging arrangement of the process cartridge inside a main body of the image formation apparatus according to a first embodiment of the invention.

When packaged, the process cartridge 9, a sheet member 70 and drying agent 80 are accommodated inside the image formation apparatus 1 as shown in FIG. 5.

The sheet member 70 is a resin sheet made of resin material, and used for holding the pair of register rollers 22 such that the pair of register rollers 22 are spaced from each other or contacting pressure between the pair of register rollers 22 is maintained to be low. For example, if the register roller 34 is a rod-like roller having a uniform diameter, and the register roller 33 has shorter cylindrical pieces intermittently arranged in the axial direction as shown in FIG. 7, the sheet member 70 is inserted to be exist at positions between positions close to right-and-left ends of the register roller 34 and feed path composing member 26 or cut-out portions of the frames 11 connected to the feed path composing member 26. Specifically, the process cartridge 9 is mounted after the sheet member 70 is placed. Alternatively, the sheet member 70 may be arranged between the feed path composing member 26 and the sheet feed surface 48, avoiding the portion where the register rollers 34 and 23 contact. In one embodiment, the sheet member 70 may have a U-shaped structure, in plan view, including a pair of portions arranged at positions close to the right-and-left ends of the register roller 34 and a portion connecting the pair of portions on the opening 7 side.

By arranging the sheet member 70 as described above, the urging pressure which urges the register roller 23 toward the register roller 23 can be received by the frames 11 and/or the portions of the feed path composing member 36 close to the frames 11, deformation of the portions where the register rollers 23 and 34 contact, deformation of feed path composing member 26, or the like can be suppressed even if the image formation apparatus 1 with accommodating the processing cartridge 9 is placed in a high temperature environment for a relatively long time in packaged state.

The drying agent 80 is accommodated in the permissible space 29 defined between the sheet feed surface 48 and the path composing member 26. The drying agent 80 an elongated shape extending in the right-and-left direction, which is perpendicular to the sheet feed direction. In an embodiment, the length of the drying agent 80 in the right-and-left direction is substantially the same as that of the process cartridge 9. Further, the front side end of the drying agent 80 is extended to outside of the clearance 29 through the opening 28.

The sheet member 70 and the drying agent 80 are connected by flexible belt member 75.

Figure 6:
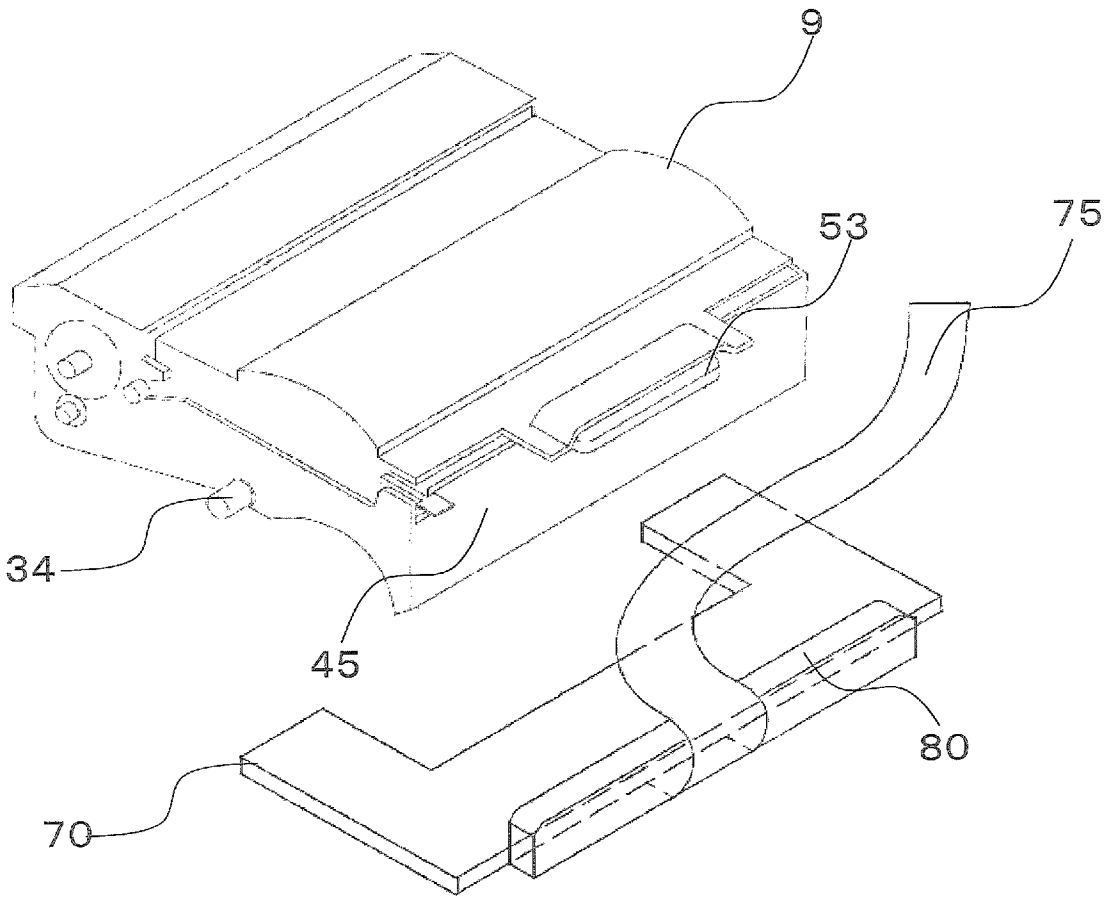
FIG. 6 shows a positional relationship of a sheet member, a drying agent and a belt member with respect to the process cartridge.

One end of the belt member 75 is connected with the front end portion of the sheet member 70 as shown in FIGS. 5 and 6. The other end of the belt member 75 is extended, passing through a space between the front end of the process cartridge 9 and the front cover 8, toward outside the image formation apparatus 1 between the front cover 8 and the housing 2.

Since the belt member 75 is extended outside the image formation apparatus 1, user can easily recognize that the sheet member 70 and the drying agent 80 should be removed before using the image formation apparatus 1.

When packaged, the image formation apparatus 1 with accommodating the drying agent 80 and the sheet member 70 as well as the processing cartridge 9 is wrapped entirely, in a well-known manner, with a flexible wrapping bag 91 made of chroloethylene or the like, and then placed in a packing box such as a cardboard box.

It is noted that, according to the embodiment, the wrapping bag 91 may be of low aeration property so that drying effect of the drying agent 80 can be enhanced. It is also noted that such a low aeration property material also prevents moisture from entering inside the image formation apparatus, and the drying effect is also improved in this regard.

According to the embodiment described above, since the drying agent 80 is arranged at the clearance between the process cartridge 9 mounted to the main body, and the second feed path 25. Conventionally, it has been a problem that, when the image formation device is transported with the process cartridge being mounted, the toner inside the process cartridge is hydrated. According to the above-described embodiment, however, since the drying agent 80 can be arranged at a position close to the toner, it becomes possible to dehydrate the toner even if the main body is packaged with mounting the process cartridge 9, Further, since the drying agent 80 is provided, it is unnecessary to form a space for accommodating further drying agents, and upsizing of the image formation apparatus can be prevented.

Furthermore, an end of the drying agent 80 is exposed to outside from the opening 28 of the second feed path 25. Therefore, when a user opens the front cover 8, the user recognizes the drying agent 80, which reminds the user of removal of the drying agent 80.

Further, according to the embodiment, in order to allow the sheet S to bend when a skew of the sheet S is removed with use of the pair of register rollers 22, the sheet feed face 48 of the second feed path is formed to an upwardly concave surface. The concave surface provides additional space for placing the drying agent, which improves dehydrating effect.]

Still further, according to the embodiment, the drying agent 80 is elongated in a direction perpendicular to the sheet feed direction. Therefore, even if the clearance, in the top-and-bottom direction, of the second feed path is relatively small, sufficient dehydration effect could be achieved by forming the drying agent 80 to be elongated in the right-and-left direction of the image formation apparatus 1.

Figure 8:
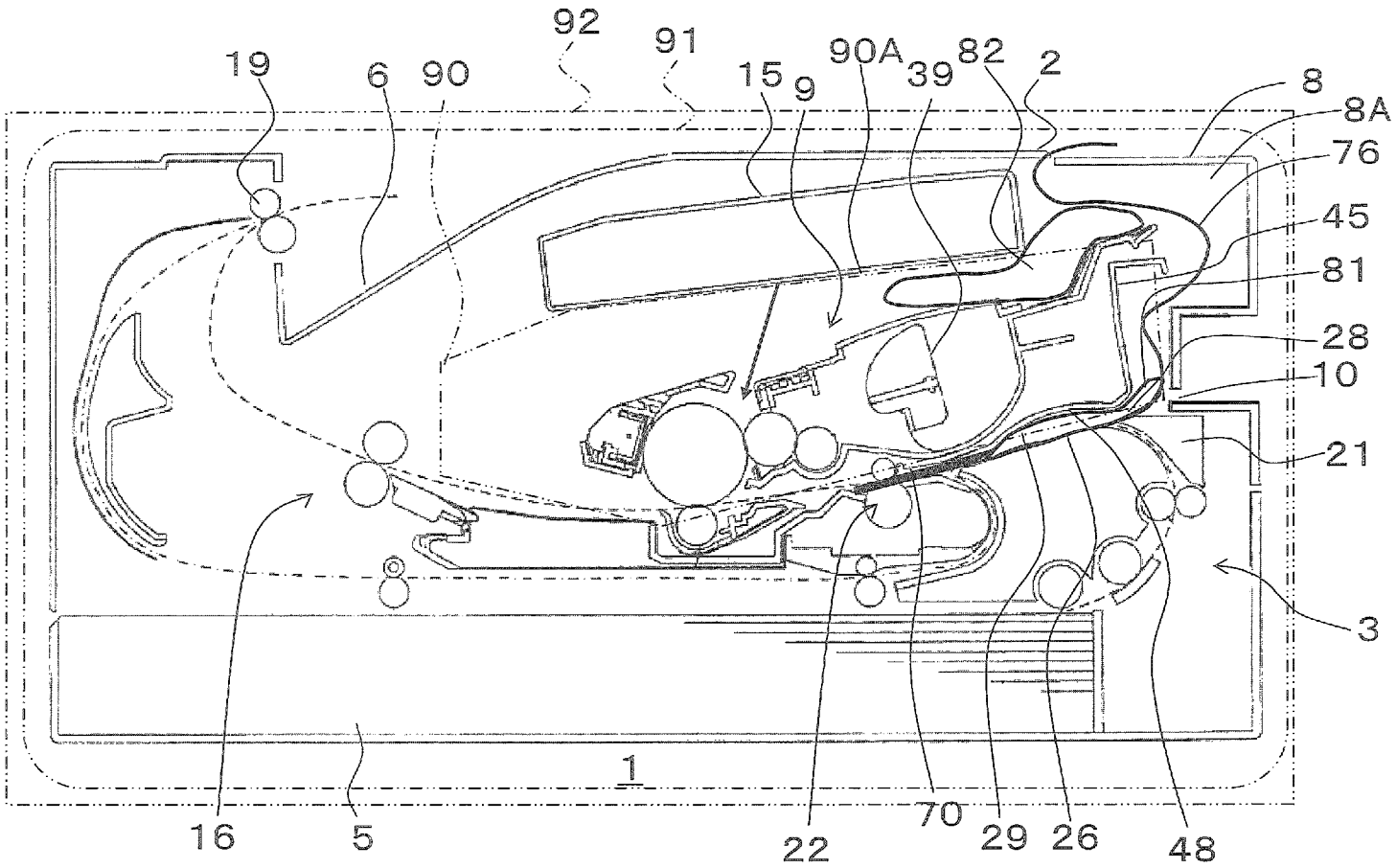
FIG. 8 is a cross-sectional side view of the image formation apparatus according to a second embodiment.

According to a second embodiment (FIG. 8), the image formation apparatus 1 is provided with a first drying agent 81 and a second drying agent 82. In the following description, members/operations which are the same as those of the first embodiment will not be described for brevity.

Each of the first drying agent 81 and the second drying agent 82 is formed to have a size and shape in accordance with a portion at which the first drying agent 81 or the second drying agent 82 is arranged. Each of the first drying agent 81 and the second drying agent 82 has substantially the same configuration as that of the drying agent 80 according to the first embodiment.

The first drying agent 81 is arranged in the admissible space 29 defined between the sheet feed surface 48 and the path composing member 26, similarly to the first embodiment. The second drying agent 82 is arranged between the top face of the process cartridge 9 and the bottom face of the exposure unit 15 which is the ceiling face 90A of the accommodation chamber 90.

With the above configuration, even if the image formation apparatus 1 is shaken during transportation, the first and second drying agents 81 and 82 absorb the shock as the silica gel therein moves. Therefore, the drying agents 81 and 82 suppress the process cartridge 9 and the image formation apparatus 1 from being damaged during transportation.

The belt member 76 connects the sheet member 70 and the first drying agent 81, and is exposed to outside the image formation apparatus 1 through an opening between the front cover 8 and the housing 2.

When the user opens the front cover 8, the belt member 76 connected to the first drying agent 81, and the second drying agent 82 are exposed to outside, and the user recognizes the same and notes necessity of removal of the same.

It is noted that, in the above-described embodiments, the process cartridge 9 is configured to be movable to be detached from or attached to the main body along a direction substantially parallel with the sheet feed direction on the second feed path 25. Such a configuration can be modified such that one side end of the second feed path 25 is opened/closed with a cover, and the process cartridge 9 is configured to be detached from or attached to the main body by moving the same in the direction substantially perpendicular to the sheet feed direction.

Further, in the above-described embodiment, the process cartridge 9, the drum cartridge 40 and the toner cartridge 60 are separate components. Such a configuration can be modified such that the drum cartridge 40 and the toner cartridge 60 are formed to be an integrated member. Furthermore, the process cartridge 9 may be configured to accommodate only the toner, while the image formation apparatus 1 is configured such that the image formation apparatus includes the photoconductive drum 31. In such a case, the process cartridge 9 may be detachable from and/or attachable to the main body.

Furthermore, in the above-described embodiments, the drying agent 81 is configured such that grains of silica gel are inserted in a bag-like member. However, according to the invention, the drying agent 81 does not need to be limited to be such a configuration. For example, instead of the packed grains of silica gel, packed grains of silica-alumina gel, calcium-chloride processed members, or calcium hydroxide may be used as the drying agent 81. Alternatively or optionally, a thin plate-like (i.e., sheet-like) drying agent may also be used as the drying agent 81 which also serves as the cushioning member.

In the above-described embodiments, the sheet member 70, the belt members 75 and 76 can be omitted. In such a case, the front ends of the drying agents 81 and 82 are arranged to be exposed, through the opening 7, to outside when the front cover 8 is opened. If the belt members 75 and 76 are used, and the belt members 75 and 76 are exposed through opening 7, it is unnecessary that the drying agents 81 and 82 are exposed to outside.

The second embodiment could be modified such that the second drying agent 82 may not be connected to the belt member 76. In such a case, if one of the first drying agent 81 and the belt member 76 is exposed to outside, the other may not be exposed to outside. If the sheet member 70, the first drying agent 81, the second drying agent 82 and the belt member 76 are connected, only by drawing the belt member 76, the sheet member 70, the first drying agent 81 and the second drying agent 82 can be detached from the image formation apparatus 1.

What is claimed is:

1. A packaging arrangement of an image formation apparatus and a process cartridge, comprising:

a main body of the image formation apparatus formed with an accommodation chamber configured to accommodate the process cartridge, the main body being formed with an opening through which the process cartridge is detachably attached to the main body, the image formation apparatus being configured to be packaged with the process cartridge attached in the accommodation chamber;

an openable cover configured to openably cover the opening;

a sheet feed tray arranged below the process cartridge and accommodating sheets, a first sheet feed path being defined such that a sheet is upwardly fed from the sheet feed tray and fed to a position in the vicinity of a bottom face of the process cartridge along the first sheet feed path, a second feed path being defined by the bottom face of the process cartridge and a path composing member arranged below and opposite to the bottom face of the process cartridge, the second feed path being connected with the first feed path, the second feed path having an opened portion at a position where the second feed path being connected to the first feed path, the opened portion being open toward the opening of the main body;

a first drying agent arranged in the second feed path with the process cartridge being attached to the main body, one of an end of the first drying agent and a member connected to the first drying agent being exposed to outside of the second feed path through the opened portion.

2. The packaging arrangement according to claim 1, further comprising a register roller configured to compensate for a skew of the sheet on an upstream side with respect an image formation position at which an image is formed on the sheet, a part of the bottom face of the process cartridge on the upstream side, in a sheet feed direction, with respect to the position where the register roller is provided being formed to be an upwardly concave face, a permission space allowing the sheet to bend being defined by the upwardly concave face and the path composing member, and the first drying agent being accommodated in the permissible space.

3. The packaging arrangement according to claim 1, wherein the first drying agent is arranged to be elongated in a direction perpendicular to a sheet feed direction of the second feed path.

4. The packaging arrangement according to claim 1, further comprising a second drying agent arranged between a top face of the process cartridge and a ceiling face of the accommodation chamber in which the process cartridge is accommodated.

5. The packaging arrangement according to claim 4, wherein a portion between the top face of the process cartridge and the ceiling face is opened toward the opening, and wherein, when the cover is closed, the cover covers the process cartridge and the second drying agent, while, when the cover is opened, one of an end of the second drying agent and a member connected to the second drying agent is exposed to outside through the portion between the top face of the process cartridge and the ceiling face.

* * * * *